United States Patent [19]

Kishi

[11] 4,348,008

[45] Sep. 7, 1982

[54] LIFTING APPARATUS

[76] Inventor: Mitsuhiro Kishi, 1320 Mizuhonocho, Ashikaga-shi, Tochigi-Pref.,, Japan

[21] Appl. No.: 148,351

[22] Filed: May 9, 1980

[51] Int. Cl.[3] ..... B66F 3/22

[52] U.S. Cl. ..... 254/122; 254/9 C

[58] Field of Search ..... 254/9 R, 9 B, 9 C, 10 R, 254/10 B, 10 C, 2 R, 2 B, 2 C, 122, 98, 100, 102, 103; 187/18, 24; 182/157, 158, 69

[56] References Cited

U.S. PATENT DOCUMENTS

Re. 29,542 2/1978 Richards ..... 187/18

FOREIGN PATENT DOCUMENTS 1080750 4/1960 Fed. Rep. of Germany ..... 254/122

2801863 5/1978 Fed. Rep. of Germany ..... 254/9 C

*Primary Examiner*—Robert C. Watson

*Attorney, Agent, or Firm*—Martin A. Farber

[57] ABSTRACT

A lifting apparatus having a carriage, a pantograph comprising a plurality of X-link units provided on the carriage, and a platform provided on the pantograph. Each X-link unit comprises a pair of outer pipes rotatably connected to each other at a central portion to form an X-link and a pair of inner pipes slidably inserted into each of the outer pipes from the opposite ends. The end of the each inner pipes of the lowermost X-link unit is connected to the carriage and the end of each inner pipe of the uppermost X-link unit is connected to the platform. Driving means for extending and retracting each inner pipe is provided in each of the outer pipes. The pantograph is extended by extending the inner pipes for elevating the platform.

5 Claims, 6 Drawing Figures

LIFTING APPARATUS

BACKGROUND OF THE INVENTION

The present invention relates to a lifting apparatus for elevating a platform so as to be suitable for working at any elevated position.

For working, repairing and painting and many other purposes at high places, lifting apparatus having a work platform for carrying workers and materials thereon have been used. Many of those conventionally used lifting apparatus have adopted a pantographic lifting mechanism, each X-link unit of which is expandable by hydraulic cylinders. In this type of lifting mechanism, the maximum height of the lifting system is limited by the length of each link which constitutes the pantograph. Therefore, in order to increase the maximum height, a longer link should be employed. This causes the size of the lifting apparatus to be considerably large.

The object of this invention is to overcome the above described drawbacks and to provide a lifting apparatus comprising X-links, each link of which comprises telescopic outer and inner pipes, the outer pipes of each X-link being able to be lifted a little with initial rising movement and the extension power of the inner pipes being securely converted into the elevating power of the work platform.

The present invention will be fully described as follows with reference to the accompanying drawings.

DETAILED DESCRIPTION OF THE PREFERRED EMBODIMENTS

Figure 1:
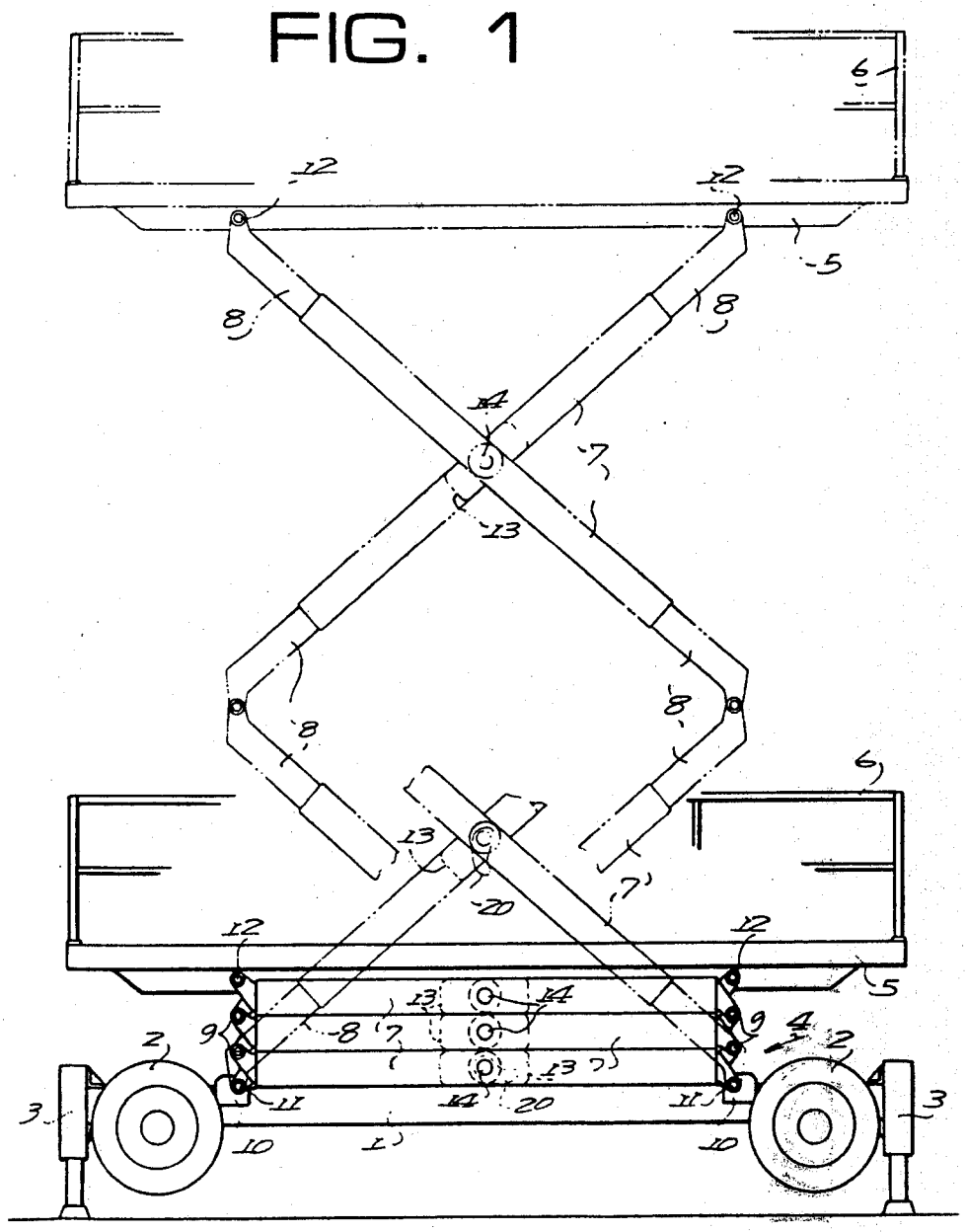
FIG. 1 is a side view showing an embodiment of the present invention.

In the drawings, a vehicle body 1 is provided with wheels 2 supported at four corners of the body 1, and extendable fixing legs 3 are secured also to the four corners of the body 1. The lifting mechanism 4 is secured on the vehicle body 2 by pins and a platform 5 is connected by pins on the upper end of the lifting mechanism. A set of handrails 6 is installed circumferentially on the platform.

The lifting mechanism comprises a plurality of X-link units. Each X-link unit comprises a pair of outer pipes 7 which are pivotally connected to each other in an X-shape, and an inner pipe 8 is telescopically inserted into each of the outer pipes 7 from each end thereof. A plurality of sets of the X-link units are superimposed and each adjacent couple of inner pipes 8 which extend from the ends of the outer pipes 7 are rotatably connected to each other by a pin 9. The ends of the lowermost inner pipes 8 are connected by pins 11 to supporting plates 10 fixed on the body 1, while the ends of the uppermost pipes 8 are connected to the work platform 5 by pins 12.

Thus, the outer and inner pipes 7 and 8 and pins 9, 11 and 12 construct a pantograph. A pair of pantographs thus assembled by the same number of X-link units are provided on the vehicle body. A driving mechanism 13 is provided on each X-link unit at the center point.

Figure 2:
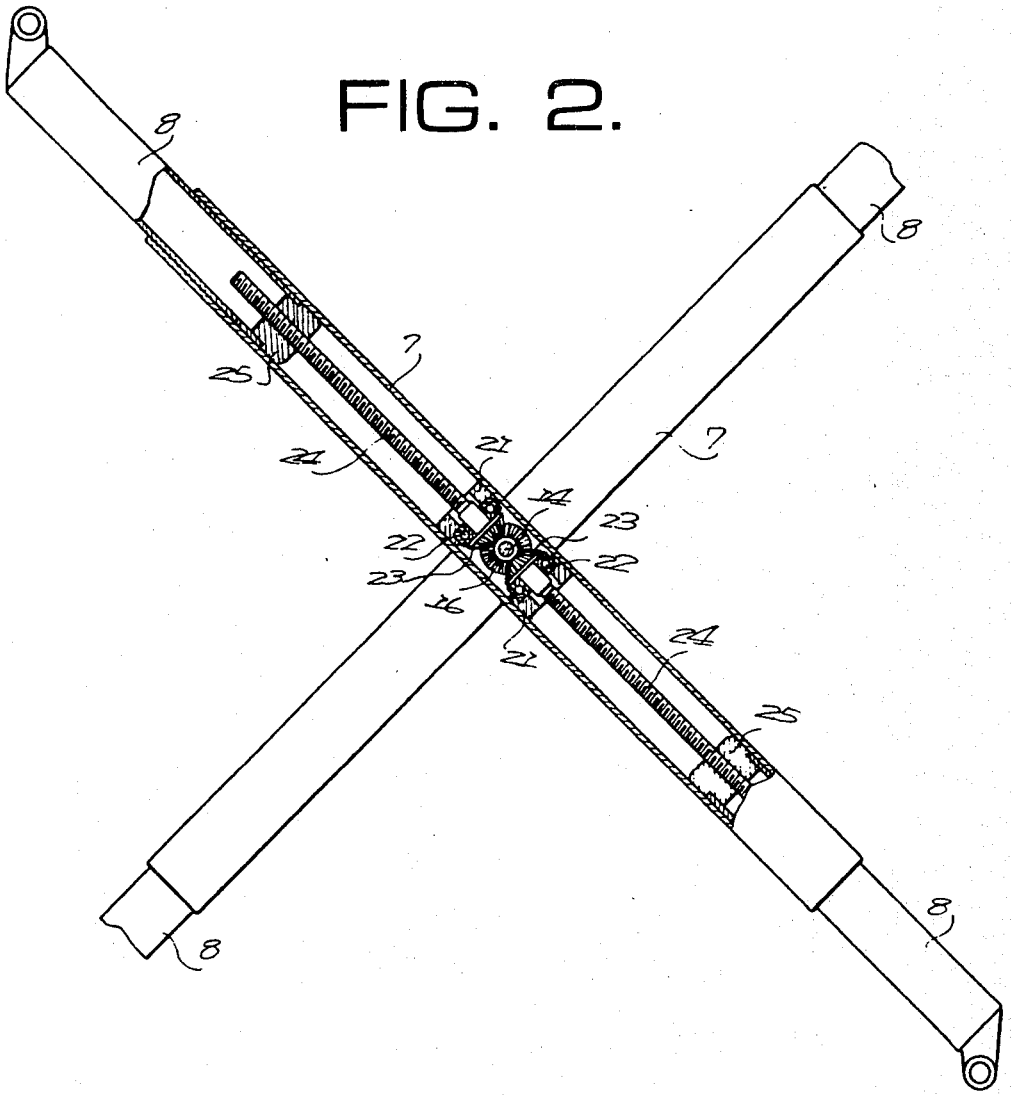
FIG. 2 is a partial cross-sectional side view showing the outer pipes of FIG. 1.
Figure 3:
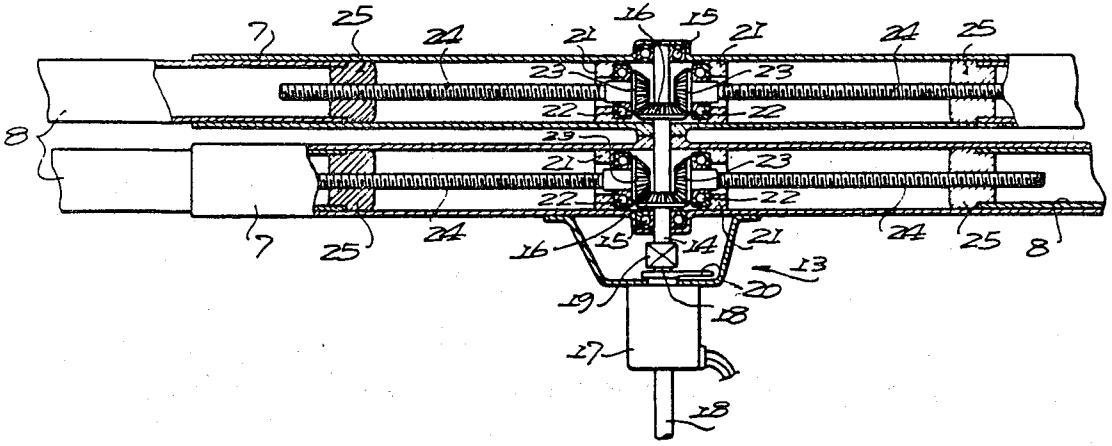
FIG. 3 is a cross-sectional view of the outer pipes.

The inside mechanism of outer pipe 7 will be described referring to FIGS. 2 and 3. A driving shaft 14 is rotatably inserted across the pivot of each X-link unit. A bearing 15 supports the driving shaft 14. Bevel gears 16 are fixed to the driving shaft 14 inside the outer tube 7 and a motor shaft 18 which has an arm 20 of arc-shape as an eccentric member is connected to the driving shaft 14 through a clutch 19. In the neighbourhood of the driving shaft 14 fixed inside the outer tube 7 is a pair of bearing members 21, each of which is provided with a thrust bearing 22. Further each thrust bearing supports pivotally a bevel gear 23 which engages with the bevel gear 16. The bevel gear is connected with a screw rod 24 extending through the center of outer tube. The screw rod 24 is engaged with a female screw member 25 fixed on the inner end of the inner pipe 8.

Following is the description of the operation of the embodiment.

Figure 4:
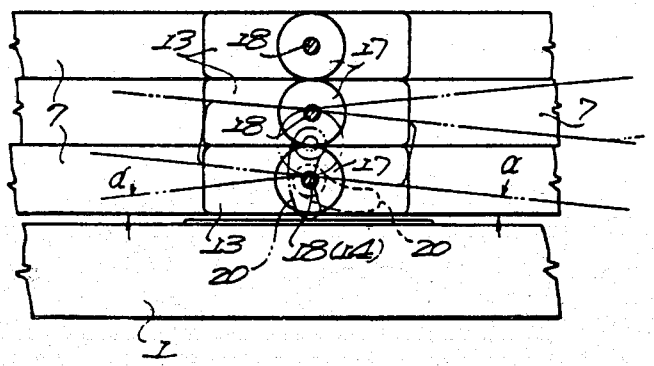
FIG. 4 is a view showing the operation of the outer pipe.

The work platform 5 is shown as in the lowermost position shown by solid lines in FIG. 1 and the outer pipes 7 having the inner pipes 8 inserted therein are superimposed and folded under the work platform 5. In order to elevate the work platform, the hydraulic motor 17 of each link unit is driven to rotate the motor shaft 18 and the arm 20. While rotating, the arm 20 gradually approaches the body 1, and the end of arm finally comes into contact with the body 1. Further rotation of the arm 20 causes lifting of the outer pipe 7. When the outer pipe makes a small angle $\alpha$ with the horizontal position shown in FIG. 4, the clutch 19 is actuated, so that the motor shaft 18 and the driving shaft 14 are connected to each other to rotate the driving shaft 14 and the bevel gear 16. The rotation of the bevel gear 16 causes the engaging bevel gears 23 and screw rods 24 to rotate. Thus, the female screws 25 threadedly engaged with the screw rods 24 are forced outwards from the outer pipes 7, pushing and extending the inner pipes 8 and moving the pins 9, 11 away from each other. Simultaneously, the pins 9, 11 and 12 are moved away from the driving shaft 14; thus the pantograph constructed by the outer and inner pipes 7 and 8 expands upwardly, resulting in the elevation of the work platform 5. On the other hand, in order to lower the work platform 5, the hydraulic motor 17 is rotated in the opposite direction.

Although the present embodiment of the invention employs an arm 20 of arc-shape as an eccentric member to lift the outer pipe 7 as an initial movement, an eccentric cam instead may be used.

Figure 5:
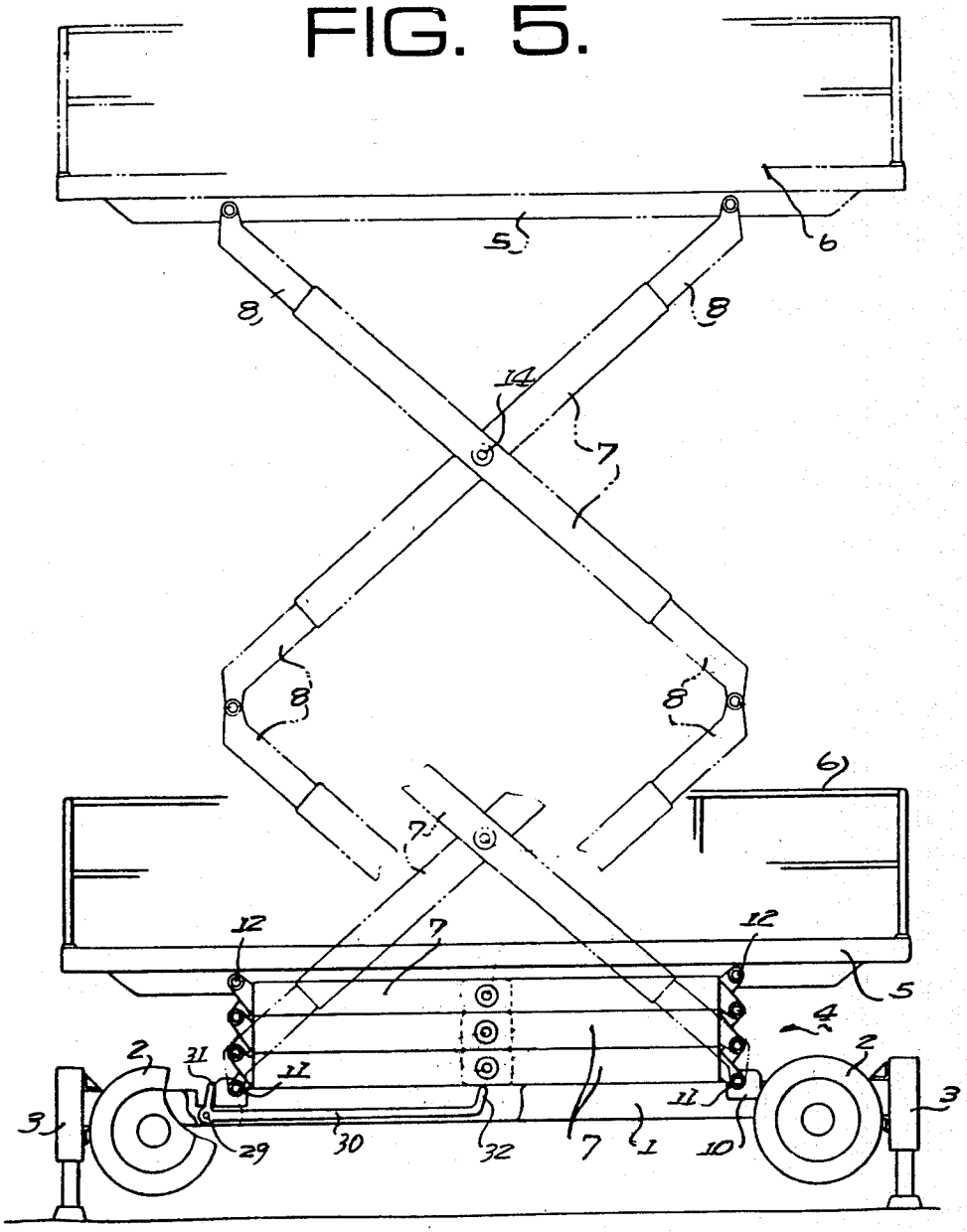
FIG. 5 is a side view showing another embodiment of the present invention.
Figure 6:
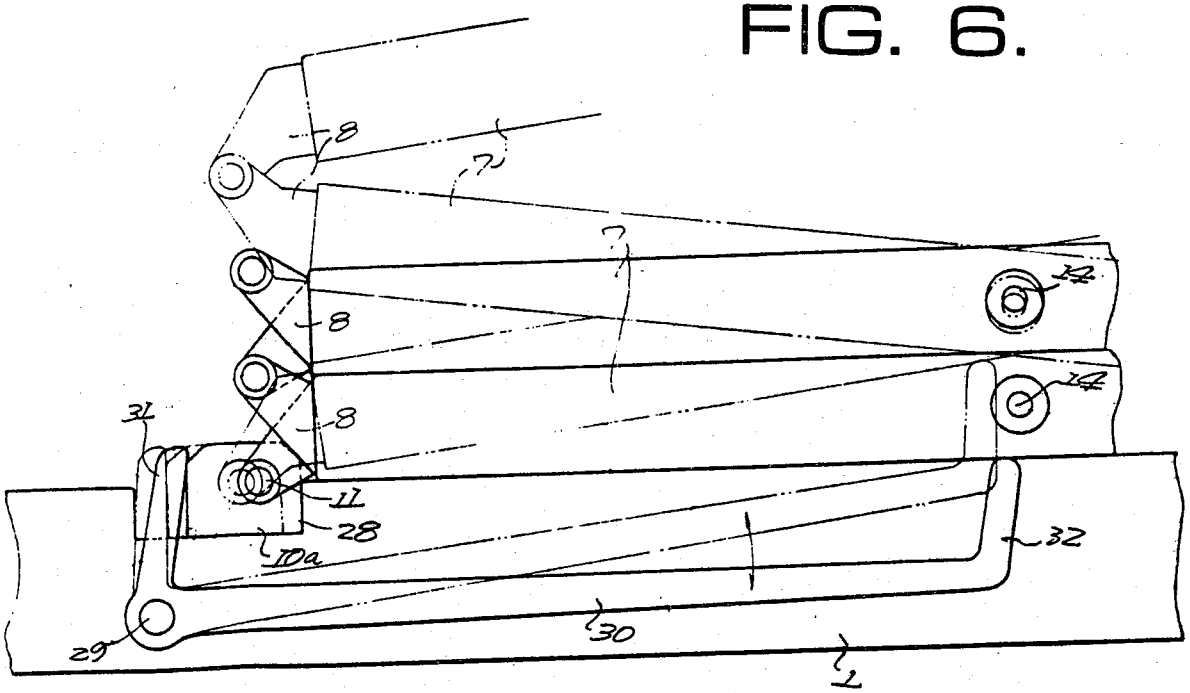
FIG. 6 is an enlarged side view showing a part of FIG. 5.

Referring to FIGS. 5 and 6 showing another embodiment of the present invention, the same parts as in the previous embodiment are identified by the same numerals as those used in FIGS. 1 to 4. In this embodiment, although the supporting plate 10 for one side of the lowermost outer pipe 7 is secured to the body 1, the other supporting plate **10*a* is slidably engaged with a guide groove 28 provided on the body 1. A pivot 29 is secured on the body 1, on which an arm 30 is rotatably mounted. One end 31 of the arm 30 is abutted on the side of the supporting plate 10*a* and the other end 32 engages with the underside of the outer pipe 7** at a central portion thereof.

Thus, when the inner pipe 8 is extended outwardly, the supporting plate **10*a* slides outwardly, so that the arm 30 is rotated about the pivot 29 in the counterclockwise direction as shown by dotted-dashed line in FIG. 6. The end 32 acts to raise the outer pipe 7. Thus, each X-link unit may be raised to extend the pantograph. In this embodiment, the clutch 19** in the previous embodiment may be omitted.

It will be understood that other mechanisms such as an oil hydraulic system may be employed for extending the inner pipe. Although the described embodiment uses a double telescopic pipe assembly comprising the outer and inner pipes, a multiple telescopic pipe assembly comprising three or more telescopic pipes may be employed.

The present invention as above-described has an advantage that the work platform may be reliably elevated, due to an initial small amount of lifting-up of the outer pipes from the horizontal position. Also when the lifting mechanisms are retracted on the vehicle body, the pair of outer pipes are folded in a plane, making the height of the folded mechanisms considerably low.

What is claimed is:

1. A lifting apparatus comprising a carriage, a pantograph comprising a plurality of X-link units provided on said carriage, a platform provided on said pantograph, each of said X-link units comprising a pair of outer pipes rotatably connected to each other at a central portion to form an X-link and a pair of inner pipes slidably inserted into each of said outer pipes from opposite ends thereof, an end of said inner pipes of a lowermost X-link unit being connected to said carriage and an end of said inner pipes of an uppermost X-link unit being connected to said platform, and means for extending and retracting said inner pipes, means for initially raising said outer pipes a small height, said initially raising means comprises a rotary eccentric member.

2. The lifting apparatus comprising a carriage, a pantograph comprising a plurality of X-link units provided on said carriage, a platform provided on said pantograph, each of said X-link units comprising a pair of outer pipes rotatably connected to each other at a central portion to form an X-link and a pair of inner pipes slidably inserted into each of said outer pipes from opposite ends thereof, an end of said inner pipes of a lowermost X-link unit being connected to said carriage and an end of said inner pipes of the uppermost X-link unit being connected to said platform, and means for extending and retracting said inner pipes, means for initially raising said outer pipes a small height, said initially raising means comprises an arm means for being rotated by extending one of said inner pipes.

3. A lifting apparatus comprising a carriage, a pantograph comprising a plurality of X-link units provided on said carriage, a platform provided on said pantograph, each of said X-link units comprising a pair of outer pipes rotatably connected to each other at a central portion to form an X-link and a pair of inner pipes slidably inserted into each of said outer pipes from opposite ends thereof, an outer end of said inner pipes of a lowermost X-link unit being connected to said carriage and an outer end of said inner pipes of an uppermost X-link unit being connected to said platform, and means provided in each of said outer pipes for extending and retracting said inner pipes, said means comprising, a driving shaft extending through said central portion of both of said outer pipes of a respective said pair of outer pipes of a respective said X-link unit, a first bevel gear inside each of said outer pipes fixed to said drive shaft, rotatable screw rods longitudinally immovably mounted inside said outer pipes and having an outer end portion threadedly engaging an inner end portion of each of said inner pipes, respectively, two second bevel gears in each of said outer pipes fixed to an inner end of each of said screw rods, respectively, said two second bevel gears meshingly engage with a corresponding said first bevel gears on opposite sides thereof, means for driving said driving shaft.

4. The lifting apparatus according to claim 3, further comprising means rigidly connected to said driving means for initially raising said lowermost X-link unit by abutting underneath an outside of said outer pipes thereof at said central portion during a turning of said driving means for initially lifting the center portion of said lowermost X-link unit, said driving means for being operatively connected to said driving shaft after said lowermost X-link unit is initially lifted.

5. The lifting apparatus according to claim 3, further comprising a supporting plate slidably mounted on said carriage and connected to said inner end of one of said inner pipes of said lowermost X-link unit, an arm pivotably mounted on said carriage and having one end being movably engaged by said supporting plate and another end liftingly abutting underneath an outside of said outer pipes of said lowermost X-link unit at said central portion during a turning of said driving means for initially lifting the center portion of said lowermost X-link unit, via said supporting plate being moved by said driving means.

* * * * *